US005210901A

United States Patent [19]

Cooper

[11] Patent Number: 5,210,901

[45] Date of Patent: May 18, 1993

[54] GAS CYLINDER CLEANSING APPARATUS

[76] Inventor: Jay Cooper, 313 Regencey Dr., Deerpark, Tex. 77536

[21] Appl. No.: 818,480

[22] Filed: Jan. 7, 1992

Related U.S. Application Data

[63] Continuation of Ser. No. 615,806, Nov. 19, 1990, abandoned.

[51] Int. Cl.[5] ..... A47L 5/38

[52] U.S. Cl. ..... 15/302; 15/304; 15/316.1; 134/166 R

[58] Field of Search ..... 15/304, 302, 316.1; 134/43, 62, 150, 152, 166 R, 169 R, 102, 171; 141/377, 369; 248/154, 230, 314

[56] References Cited

U.S. PATENT DOCUMENTS

| | | | |
|---|---|---|---|
| 1,492,949 | 5/1924 | Allison | 15/304 |
| 1,893,652 | 1/1933 | Reich | 134/150 |
| 3,213,479 | 10/1965 | Wilkie | 15/304 |
| 3,963,036 | 6/1976 | Irelan, Jr. | 15/304 |
| 4,091,495 | 5/1978 | Aspenlind | 15/304 |

OTHER PUBLICATIONS

Galisco, Inc. Brochure Cover and pp. B-2.2, B-2.3, issued Dec. 1, 1982; p. 14, issued Apr. 1, 1984, and p. B-3.0, issued Apr. 20, 1982.

Hydro-Test Products, Inc. Brochure, dated 1987, pp. A-43, A-44 and A-51.

*Primary Examiner*—Harvey C. Hornsby
*Assistant Examiner*—Reginald L. Alexander
*Attorney, Agent, or Firm*—Kenneth H. Johnson

[57] ABSTRACT

There is provided a relatively simple and inexpensive combination cylinder inverter and cleansing apparatus. A cradle for the cylinder is rotatably mounted for inversion on a frame. An adjustable head plate is mounted on the cradle to both support the cylinder on the cradle when inverted and insert a nozzle for the cleansing and drying fluid. A flexible pressure hose and fittings are provided to allow filling the cylinder with water for washing and supplying air for the drying operation.

2 Claims, 2 Drawing Sheets

GAS CYLINDER CLEANSING APPARATUS

This application is a continuation of application Ser. No. 07/615,806, filed Nov. 19, 1990, now abandoned.

BACKGROUND OF THE INVENTION

1. Field of the Invention

The present invention relates to apparatus for holding, inverting and cleaning empty gas cylinders.

2. Related Art

Gas containing cylinders, sometimes called bottles, often have to be cleaned after use. Certain of the cylinders, such as compressed gas for soft drink dispensers, are required to be cleansed after each use, or periodically hydrostatically tested, that is, when empty and prior to being refilled. While the procedure would appear to be simple, there are physical problems associated with such cleansing. In most cases simple washing of the inside of the cylinder is sufficient. However, prior to reuse the cylinder must be drained of wash water or test water and dried, usually with compressed air. The physical size and weight of a single gas cylinder, even when empty, greatly increases the difficulty of handling during the cleansing operation.

Cylinder inverters can facilitate the cleaning operations, and there are presently some available, including a simple cylinder inversion apparatus. Additionally, there are more sophisticated automatic cylinder inverters that are air powered. The first suffer from lack of washing and drying facilities and the latter from the expense.

SUMMARY OF THE INVENTION

In order to meet the needs of the gas cylinder cleansing industry a relatively simple and inexpensive combination cylinder inverter and cleansing apparatus is provided. A cradle for the cylinder is rotatably mounted for inversion on a frame. An adjustable head plate is mounted on the cradle to both support the cylinder on the cradle when inverted and insert a nozzle for the cleansing and drying fluids. A flexible pressure hose and fittings are provided to allow filling the cylinder with water for washing and supplying air for the drying operation.

DESCRIPTION OF THE PREFERRED EMBODIMENT

Figure 1:
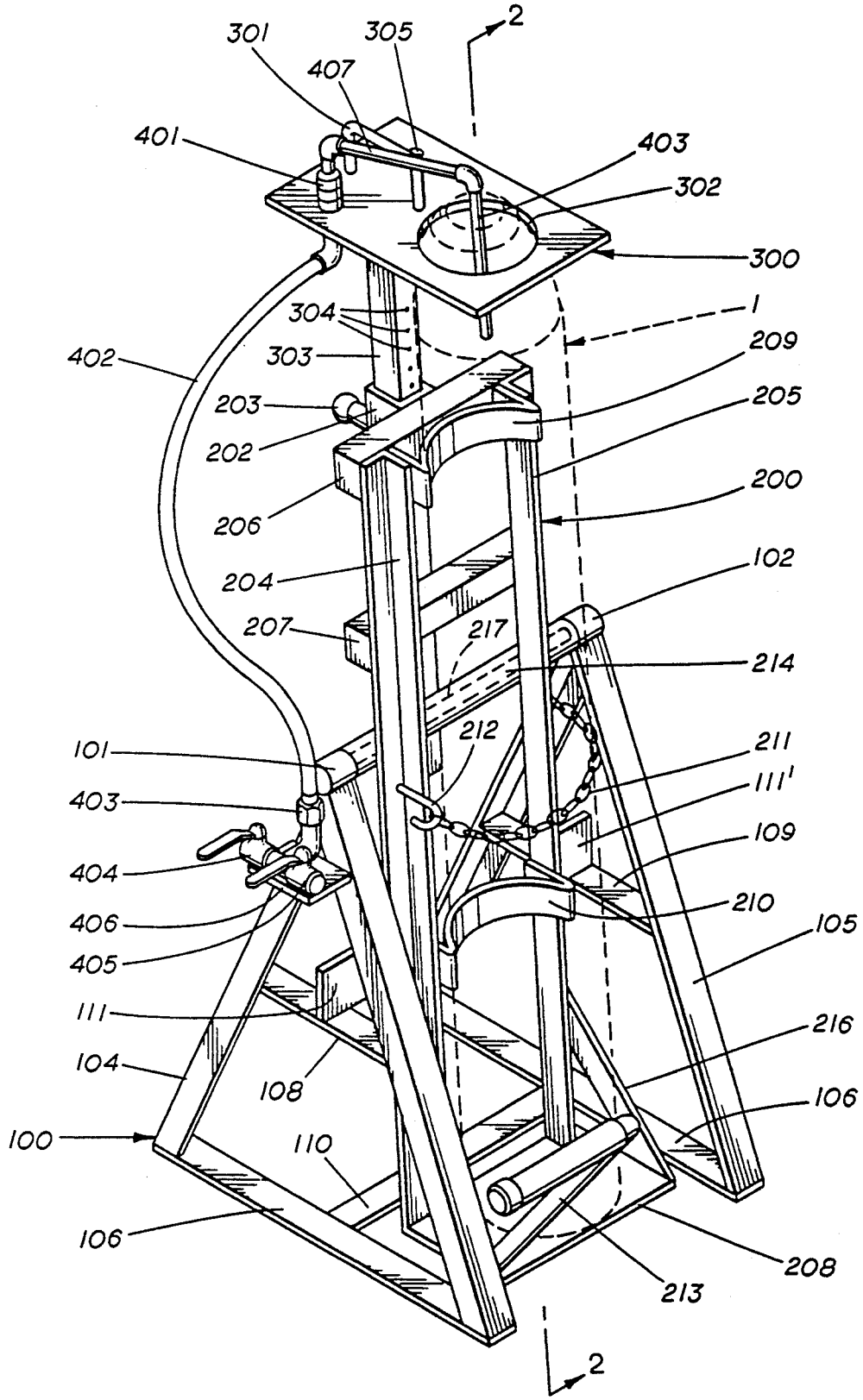
FIG. 1 is an isometric view of a preferred embodiment of the invention.
Figure 2:
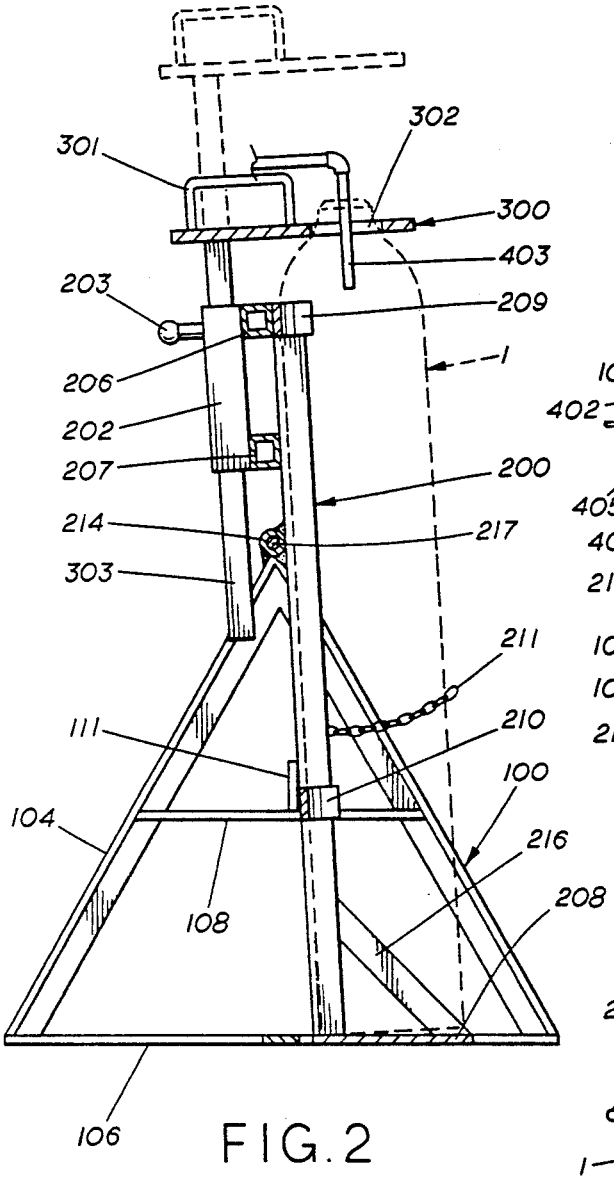
FIG. 2 is a side elevational view of the embodiment of FIG. 1.
Figure 3:
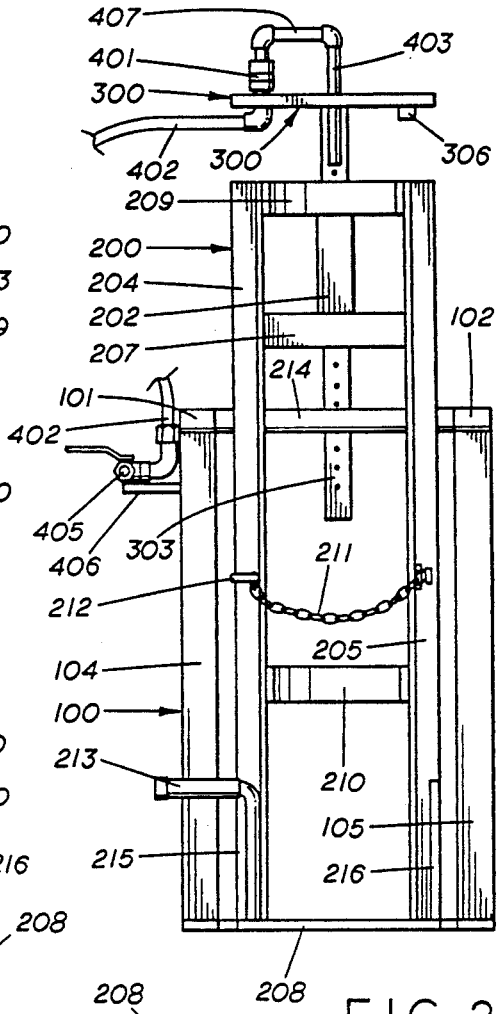
FIG. 3 is a front elevational view of the embodiment of FIG. 1.

For a detailed description of the preferred embodiment the reader is directed to the accompanying figures in which like components are given like numeral for ease of reference. In the figures the gas cylinder or bottle is shown in dashed lines as it is not a part of the invention.

The gas cleansing apparatus is shown to comprise a frame 100, a gas cylinder cradle 200 rotatably mounted on the frame 100 and a height adjustable head plate 300 which is secured to and extending over the top of cradle

200. A handle 301 is provided to assist in raising and lowering the head plate 300. In the head plate 300 directly above the cradle 200 there is provided an opening 302 which fits snugly about the top of a gas cylinder secured in the cradle.

Mounted on the head plate 300 is a fluid inlet means which comprises a fitting 401 through the plate 300, a horizontal length of pipe 407, and a nozzle 403 which extends downward through opening 302, and into the gas cylinder 1 when the plate 300 is adjusted properly. On the underside of fitting 401 is connected a conduit means in the form of a flexible pressure hose 402 which leads to fitting 407. Two ball valves 404 and 405 are secured to fitting 407 which is turn is secured to plate 406 mounted on frame 100. Preferably the fitting is snap on quick release type such that the pipe and nozzle may be conveniently removed.

The cradle 200 is seen to comprise two vertical side members 204 and 205, shown made of angle irons. The two vertical side members 204 and 205 are joined by two cross members 206 and 207, the first 206 being at the top and the second 207 being somewhat lower. A horizontal plate 208 is secured to the side members 204 and 205 at the bottom and braced by brace members 216 and 215. The bottom plate 208 serves as a resting place for the cylinder 1 when in the upright position. There are also provided two concave cradle members 209 and 210 secured to the side members 204 and 205, the first 209 being at the top and the second 210 being near the bottom. The concave cradle members 209 and 210 generally conform to the shape of a gas cylinder. A chain 211 is secured by one end to one of the vertical side members 205. The freed end of chain 211 may be passed tightly about gas cylinder 1 and secured to hook 212 attached to opposite side member 204. A handle 213 is provided which extends outward and upward from bottom plate 208 to aid in rotating the cradle 200 from the upright to the inverted position.

The cradle 200 is secured to sleeve 214 which is rotatably mounted on rod 217 which is welded in sockets 101 and 102 on the top of either side of frame 100. The frame 100 is shown to comprise two A-shaped members 104 and 105, each having cross members 106 and 107 at the bottom and 108 and 109 in the middle. the bottom cross members 106 and 107 are connected by flat member 110. Vertical flat members 111 and 111', respectively, are attached to each of middle cross members 108 and 109 and extend toward each other to contact cross member 206, forming a stop when the cradle is inverted as shown FIG. 4. Members 111 and 111' do not extend across the frame and are of a length to avoid contact with member 303 when the cradle is inverted.

The head plate 300 is adjustably mounted to rear of cradle 200 for adjustment along the longitudinal axis by means of a first rectangular member 303 which slides into a hollow rectangular 202 which is fixedly attached to cradle cross members 206 and 207. The first rectangular member 303 is provided with vertically aligned opposing apertures 304 through which pin 203 may be inserted to secure the plate 300 at the desired height. Pin 203 may be a popping pin device welded to member 202, i.e., a spring loaded pin which is biased toward the openings 304 in member 303 through an opening (not shown) in 202. The flexible hose 402 allows the head plate 300 to be easily adjusted to the desired height while allowing a fixed connection to the water and air sources.

In use, the head plate 300 is first raised to a sufficient height for the nozzle 403 to clear the top of cylinder. The pipe and nozzle 403 are removable as a unit to allow inspection of the interior of the cylinder. The cylinder 1 is then secured in the upright position using chain 211 and hook 212. Water and air supplies are connected to valves 404 and 405 (or vice versa). The head plate 300 is lowered into position such that opening 302 fits snugly about the upper end of cylinder 1 and nozzle 403 extends into the top of the cylinder. Pin 203 is then inserted to secure the head plate 300 into position. Also positioned on the plate 300 is an aperture 305 and a bushing 306 aligned with the aperture and extending below the plate, which is provided as a holder for the pipe and nozzle unit when it is removed.

Figure 4:
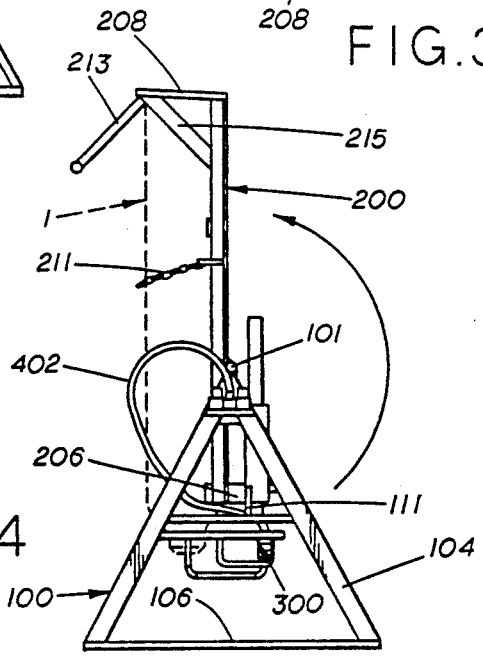
FIG. 4 is a side elevational view of the embodiment of FIG. 1 in the inverted position.

The cylinder is flushed with water, and soap if desired, until clean from water passing through valve 404, hose 402, pipe 407 and nozzle 403. The cylinder is then inverted using handle 213 by rotating the cradle 200 attached to sleeve 214 about rod 217 until cross member 206 strikes the vertical flat members 111 as shown in FIG. 4. The water can then be allowed to drain from the inverted cylinder by gravity or can be forced out using compressed air supplied through valve 405. After the cylinder is empty of water, it may be dried using the compressed air.

Alternatively, the cylinder may be rotated to the inverted position (FIG. 4) prior to washing and the wash solution, e.g., water injected under sufficient pressure to strike the internal bottom surface of the inverted cylinder and simultaneously drain out of the open mouth of the cylinder.

The foregoing description of the invention has been directed to a particular preferred embodiment of the present invention for purposes of explanation and illustration. It will be apparent to those skilled in the art that many modifications and changes in the apparatus may be made without departing from the scope and spirit of the invention. It is, therefore, intended that the following claims cover all equivalent modifications and variations as fall within the scope of the invention as defined by the claims.

The invention claimed is:

1. A gas cylinder handling apparatus comprising;

(a) a first frame for mounting on a surface (b) a second frame for holding a gas cylinder said second frame being rotatably mounted on to said first frame for rotation within said frame, said second frame having an upper and lower end, (c) stop means to prevent rotation of said second frame beyond the vertical inverted position, (d) a means to removable clasp a gas cylinder to said second frame (e) a first horizontally extending planar plate at the lower end of said second frame on which to seat an upright cylinder, (f) a second horizontally extending flat plate positioned at the upper end of said second frame, a cradle member attached to said second frame, a vertically adjustable member which is slidable within said cradle and adjustable along the vertical axis of said second frame, said second plate attached to said adjustable member and said second plate having an opening therein which is adapted to fit over and received therein the upper end of an upright gas cylinder, said member additionally comprising means to releasably lock said member and said second plate in selected vertical positions relative to said cradle and said second frame, (g) a fluid inlet tube mounted to second plate and extending through said opening toward said first plate for extending into open upright gas cylinder, mounted in said second frame and engaged said opening of said second plate, (h) a water/air dual valve means mounted on said first frame (i) a flexible conduit fluidly connecting said water/air valve to said fluid inlet tube and (j) a handle extending outwardly and upwardly from the first plate for manual rotation of said second frame.

2. The gas cylinder handling apparatus according to claim 1 wherein said means to clasp comprises a chain affixed to said second frame at one point and releasably attachable to said second frame at a juxtaposed point.

* * * * *